US011140927B2

(12) United States Patent
Gellineau

(10) Patent No.: US 11,140,927 B2
(45) Date of Patent: Oct. 12, 2021

(54) WIRE GUIDANCE SYSTEM AND METHOD OF USE

(71) Applicant: Leon Sidney Gellineau, Huntington Station, NY (US)

(72) Inventor: Leon Sidney Gellineau, Huntington Station, NY (US)

( * ) Notice: Subject to any disclaimer, the term of this patent is extended or adjusted under 35 U.S.C. 154(b) by 0 days.

(21) Appl. No.: 15/955,275

(22) Filed: Apr. 17, 2018

(65) Prior Publication Data

US 2018/0228223 A1 Aug. 16, 2018

Related U.S. Application Data

(63) Continuation of application No. 15/587,980, filed on May 5, 2017, now Pat. No. 9,943,121.

(60) Provisional application No. 62/411,136, filed on Oct. 21, 2016, provisional application No. 62/391,612, filed on May 6, 2016.

(51) Int. Cl.
*B65D 33/16* (2006.01)
*A41D 1/00* (2018.01)

(52) U.S. Cl.
CPC ..... *A41D 1/002* (2013.01)

(58) Field of Classification Search
CPC ..... Y10T 24/155; Y10T 24/398; Y10T 24/44017; A41D 1/002; F16G 11/00
See application file for complete search history.

(56) References Cited

U.S. PATENT DOCUMENTS 400,721 A * 4/1889 Wheeler et al. ..... A41F 5/00 2/107
957,617 A * 5/1910 Marx et al. ..... A41C 3/00 2/265
987,407 A 3/1911 Scott
1,242,139 A 10/1917 Callahan
2,484,219 A * 10/1949 Glick ..... A41C 3/124 2/265

(Continued)

FOREIGN PATENT DOCUMENTS

CN 205017517 U 2/2016
WO 2005045110 A1 5/2005
WO 2011050411 A1 5/2011

OTHER PUBLICATIONS

PCT International Report on Patentability for PCT/US2017/031288 dated Nov. 15, 2018 (7 pages).

(Continued)

*Primary Examiner* — Jason W San
(74) *Attorney, Agent, or Firm* — Carter, DeLuca & Farrell LLP; George Likourezos

(57) ABSTRACT

Disclosed are garments with selective wire management systems, as well as ports for adapting garments without selective wire management systems. Garments for wire management may include one or more ports which define an aperture through which headphone wire is passed. The ports provide both support to the headphone wire as well as to the garment, thereby preventing tearing of the garment more than is necessary to accommodate the wire. Further, ports may be selectively placed on a garment, as desired, to provide optimal entrance and exit placement of headphone wire. In addition to the ports, a channel may connect the ports, thereby selectively routing the wire along the garment.

16 Claims, 7 Drawing Sheets

(56) References Cited

U.S. PATENT DOCUMENTS 2,594,259 A * 4/1952 Fitch ..... A41D 27/04 2/265
2,706,816 A * 4/1955 Dozier ..... A41C 3/0028 2/104
2,709,259 A * 5/1955 Mason ..... A41B 1/10 2/128
2,724,835 A * 11/1955 Connors ..... A41B 13/08 2/112
2,729,822 A * 1/1956 Arkin ..... A41D 1/22 2/221
2,807,804 A * 10/1957 Miller ..... A41D 15/00 2/126
2,807,850 A 10/1957 Davidson
3,401,434 A 9/1968 Daddona, Jr.
3,416,196 A 12/1968 Mathison
3,553,796 A 1/1971 Carlile
3,820,200 A 6/1974 Myers
4,357,740 A 11/1982 Brown
4,404,460 A * 9/1983 Kerr ..... A41D 13/0051 2/69
4,644,610 A 2/1987 Fish
4,646,394 A 3/1987 Krauss
4,697,312 A 10/1987 Freyer
4,876,724 A * 10/1989 Suzuki ..... H04R 5/023 381/385
4,914,789 A 4/1990 Pedersen
5,027,478 A 7/1991 Suhr
5,208,920 A * 5/1993 Schaefer ..... A41D 1/06 2/108
5,381,588 A 1/1995 Nelson
5,644,799 A 7/1997 Armenta
5,647,107 A 7/1997 Brewster
5,695,088 A 12/1997 Kasbohm
6,006,406 A 12/1999 Chung
6,109,818 A 8/2000 Engel
6,151,759 A 11/2000 Harward
6,161,263 A 12/2000 Anderson
6,260,240 B1 7/2001 Akashi
6,324,053 B1 * 11/2001 Kamijo ..... G06F 1/163 2/264
6,393,678 B1 5/2002 Fildan
6,442,808 B2 9/2002 Fildan
6,449,810 B1 9/2002 Kuwayama
6,563,424 B1 5/2003 Kaario
6,757,945 B2 7/2004 Shibuya
6,792,124 B2 * 9/2004 Tilbury ..... A41D 1/005 381/301
6,818,816 B2 * 11/2004 Roberts ..... A41D 1/005 2/102
6,826,782 B2 * 12/2004 Jordan ..... A41D 1/005 2/94
7,013,539 B2 3/2006 Fildan
7,035,422 B1 4/2006 Wiener
7,380,371 B2 6/2008 Jones
7,519,192 B1 * 4/2009 Laycock ..... A41D 1/005 381/301
7,752,718 B2 7/2010 Fisher
7,974,432 B1 7/2011 Ryan
8,107,653 B2 1/2012 Wolfe
8,225,465 B2 7/2012 Honeycutt
8,341,766 B2 * 1/2013 Rodriguez ..... A41D 3/00 2/93
8,407,868 B2 4/2013 Chung
8,411,891 B2 4/2013 Del Prete
D688,849 S * 9/2013 Kochling ..... D2/840
8,613,112 B2 * 12/2013 Santucci ..... A41D 1/005 2/115
8,625,835 B2 1/2014 Gotlieb
8,687,834 B2 4/2014 Wolfe
8,782,814 B2 7/2014 Schmelzer
8,935,835 B2 1/2015 Fildan
8,942,403 B2 1/2015 Oman et al.
9,242,093 B1 * 1/2016 Sherman ..... A61N 1/36032
9,271,533 B2 * 3/2016 Kochling ..... A41D 27/205
9,332,796 B2 5/2016 Edwards et al.
9,339,064 B2 5/2016 Oliver
9,480,310 B2 11/2016 Hernandez et al.
9,943,121 B2 4/2018 Gellineau
10,154,694 B2 * 12/2018 Scheffler ..... A61B 5/0002
2004/0154076 A1 8/2004 Yoo
2004/0237168 A1 * 12/2004 Braun ..... A41D 27/28 2/93
2006/0005361 A1 1/2006 O'Banion
2006/0048345 A1 3/2006 Hasegawa
2006/0062413 A1 3/2006 Wehrell
2006/0075537 A1 * 4/2006 Tsai ..... A41D 1/005 2/69
2006/0099864 A1 5/2006 Crumrine et al.
2006/0182297 A1 8/2006 Cyr et al.
2007/0028346 A1 * 2/2007 Williams ..... A41D 1/005 2/69
2007/0245444 A1 * 10/2007 Brink ..... A41D 1/005 2/69
2008/0256759 A1 10/2008 Kasbohm
2009/0031474 A1 * 2/2009 Komorowski ..... A41D 13/0012 2/114
2009/0094725 A1 * 4/2009 Smith ..... A41D 1/04 2/69
2009/0139013 A1 * 6/2009 Sapowycz ..... A41D 1/005 2/247
2010/0031415 A1 * 2/2010 Shadid ..... A41D 13/0012 2/87
2010/0100997 A1 * 4/2010 Lee ..... H01R 13/2407 2/69
2010/0329499 A1 12/2010 Wolfe
2011/0019861 A1 1/2011 Wolfe
2011/0185469 A1 8/2011 Santuccio et al.
2012/0079687 A1 4/2012 Ingram
2012/0186000 A1 * 7/2012 Raviv ..... A41B 1/00 2/247
2012/0201412 A1 * 8/2012 Del Prete ..... H04R 1/1033 381/374
2012/0272431 A1 11/2012 Kupinic
2013/0042384 A1 * 2/2013 Mitchell ..... A42B 1/048 2/84
2013/0130540 A1 5/2013 Oman et al.
2014/0304885 A1 * 10/2014 Oliver ..... A41D 1/04 2/84
2014/0338094 A1 * 11/2014 Keathley ..... A41D 3/00 2/94
2015/0143601 A1 * 5/2015 Longinotti-Buitoni ..... A61B 5/0002 2/69
2015/0189931 A1 * 7/2015 Elliott ..... A41D 19/0041 2/336
2015/0196061 A1 * 7/2015 Oliver ..... A24F 47/008 2/84
2015/0374056 A1 * 12/2015 Gheneva ..... A41D 27/205 2/85
2016/0165975 A1 * 6/2016 Reuben ..... A41D 15/04 2/69.5
2016/0374421 A1 12/2016 Washington
2019/0008454 A1 * 1/2019 Hsu ..... A61B 5/6804
2019/0133215 A1 * 5/2019 Whalen ..... A63B 23/03508
2019/0364983 A1 * 12/2019 Nakajima ..... A61B 5/6804
2019/0380397 A1 * 12/2019 Plant ..... A41D 3/005
2019/0380398 A1 * 12/2019 Plant ..... A41D 3/005
2020/0029899 A1 * 1/2020 Bogdanovich ..... A61M 39/02

OTHER PUBLICATIONS

PCT International Search Report and Written Opinion dated Aug. 3, 2017 (13 pages).

* cited by examiner

WIRE GUIDANCE SYSTEM AND METHOD OF USE

CROSS-REFERENCE TO RELATED APPLICATIONS

The present application is a continuation of U.S. patent application Ser. No. 15/587,980, filed on May 5, 2017, which claims priority to, and the benefit of, U.S. Provisional Patent Application Ser. No. 62/391,612, titled "In re Patent Application of Leon Sidney Gellineau for a Garment with Wire Management System," filed on May 6, 2016, and U.S. Provisional Patent Application Ser. No. 62/411,136 titled "WIRE CONTROL SYSTEMS FOR CLOTHING AND CONTROL SYSTEM ACCESSORIES," filed on Oct. 21, 2016, the entire contents of both of which are hereby incorporated by reference.

TECHNICAL FIELD

The present disclosure relates to garments designed to route peripheral wires associated with media player headphones; more particularly, to fabric piping and attachments which permit routing of wire through an article or articles of clothing.

BACKGROUND

The advent of portable audio playback devices, and their subsequent improvement over the years, has led to increasing consumer demand for not only portable music players, but the peripherals associated with these devices.

Among such peripherals are headphones which generally come with at least one ear piece and a wire to be connected to the portable audio playback device. Though headphone technology has expanded into the wireless spectrum, many headphone manufacturers continue to produce and sell wired headphones for public consumption. Wired headphones are often selected due to their known interoperability with an individual's portable audio playback device, their reduced maintenance needs due to often simpler construction, and familiarity of use to the individual.

Though headphones are often a more ergonomic and long-term solution to an individual's peripheral needs, they are not without their limitations. Often, headphone manufacturers must select wire lengths commiserate with the activity being performed by the user, must consider how the portable audio playback device will be located on the individual, and whether the wire may be compromised by foreign objects to the individual using the headphones as well as elements such as sweat and water.

While various solutions exist to route cables through garments, such solutions are often tailored to ergonomic use and routing for largely sedentary individuals, or individuals otherwise engaging in casual activities.

SUMMARY

In addition to routing cables through garments in an ergonomic fashion, individuals may desire cables routed for both comfort and ease of concealment while engaging in heightened physical activity. Likewise, individuals may also prefer a variety of routing configurations designed to address different physical activity wire routing requirements, or even the ability to fit garments with custom wire routing paths.

Described herein are wire control systems and control system accessories for custom routing of wires through garments. In one embodiment in accordance with the present disclosure there is disclosed a garment for managing the translation of a wire through the garment, the garment comprising: an originating port, the originating port capable of receiving headphone wire; a terminating port, the terminating port capable of receiving headphone wire through the port; and a first channel coupled to the originating port and terminating port, defining a path for wire translation between the originating port and the terminating port. The garment further comprises a third port disposed along the first channel and operatively connected to the first channel, permitting transmission of wire through the garment. The garment further comprises a third channel extending between either the originating port, terminating port, or a third port, and terminating at a forth port, thereby defining a path for wire translation between either the originating port, terminating port, third port, and forth port. The garment further comprises a second channel extending between a second originating port and a second terminating port, the second channel defining a path for wire translation between the second originating port and the second terminating port.

According to aspects of the present disclosure, there is disclosed a port sealer, comprising: a port sealer membrane; and an aperture, the aperture being contained within the port sealer membrane and permitting communication between an exterior surface and an interior surface. The port sealer further comprises a buttress enclosing the aperture, the buttress being located on the exterior surface of the port sealer membrane. The port sealer further comprises a second buttress enclosing the first buttress, the second buttress being located on the exterior surface of the port sealer membrane. The port sealer further comprises at least one fastener, the fastener configured to be fixed to garment. The port sealer further comprises at least one receiver, the receiver configured to be coupled to a fastener attached to a second port sealer. The port sealer further comprises at least one fastener, the fastener configured to be attached to garment.

In aspects of the present disclosure, there is disclosed a kit comprising: a port sealing apparatus including a first port sealer with a membrane and at least one fastener and a second port sealer with a membrane and at least one receiver, the first and second port sealer designed to be coupled with garment between the first and second port sealer and further including an aperture. The kit further comprises a channel, the channel including a membrane and designed to be in operative communication with the first port sealing apparatus; and a second port sealing apparatus designed to be in operative communication with the channel. The port sealing apparatus further includes a buttress enclosing the aperture located on the membrane. The first and second port sealing apparatus further include a buttress enclosing the aperture located on the membrane. The kit may further include a fabric punch.

According to aspects of the present disclosure, a port sealer may include a port sealer membrane. The port sealer membrane may be configured to couple to clothing fabric. The port sealer membrane may define a plane and an aperture therethrough. The aperture may permit communication of wire through the port sealer.

In aspects, the port sealer may include a first and second surface defined by the membrane, and a first buttress disposed along the first surface. The first buttress may enclose the aperture and extend outward from the plane defined by the first surface. The first and second surfaces may be on opposing sides of the membrane.

The port sealer may further include a second buttress enclosing the first buttress. The second buttress may be located on the first surface of the port sealer membrane. The second buttress may be located along a periphery of the first surface.

The port sealer may further include at least one fastener located on the second surface. The fastener may be configured to engage fabric.

According to aspects of the present disclosure, a port sealing system is disclosed including a port sealer. The port sealer may include a port sealer membrane configured to couple to clothing fabric. The port sealer may define a plane with an aperture therethrough. The aperture may permit communication of wire through the port sealer membrane. The port sealing system may further include a first buttress disposed along the first surface of the port sealer. The first buttress may enclose the aperture and extend outward from the plane defined by the first surface. The first and second surface may be on opposing sides of the membrane.

The port sealing system may further include a second buttress located on the port sealer. The second buttress may be located on the first surface of the port sealer membrane. The second buttress may also be located along a periphery of the first surface. At least one fastener may be located on the second surface, the at least one fastener configured to engage a fabric surface.

According to aspects, the port sealer system may include a second port sealer including a membrane defining a second plane, the membrane having a first and second surface. The second port sealer may include a first buttress disposed along the first surface of the second port sealer, the first buttress of the second port sealer enclosing an aperture defined by the membrane of the second port sealer. The first buttress of the second port sealer may extend outward from the second plane defined by the first surface. The first and second surface may be on opposing sides of the membrane.

According to aspects, the second surface of the port sealer may have a plurality of male connectors extending from the second surface. The second surface of the second port sealer may have a plurality of female connectors located thereon. The plurality of male connectors located on the port sealer may correspond to the plurality of female connectors located on the second port sealer. The plurality of male connectors may be configured to engage the plurality of female connectors.

According to aspects of the present disclosure, there is a kit provided having a first port sealing unit including a first port sealer and a second port sealer. The first port sealer may have a first membrane and a first fastener disposed on the membrane. The second port sealer may have a second membrane and a second fastener. The first and second port sealer may be configured to couple to opposing sides of garments. The first and second port sealer defines a first and second aperture, respectively.

In aspects, the first fastener is a male fastener and the second fastener is a female fastener.

According to aspects, the kit further includes a channel membrane configured to be in operative communication with the first port sealing unit at a first channel membrane end, and a second port sealing unit located at a second channel membrane end.

In aspects, the port sealing unit includes a first port sealer buttress located on the first port sealer. A second port sealer buttress may be located on the second port sealer.

According to aspects, the kit further includes a fabric punch.

In aspects, the kit further includes a plurality of port sealing units.

DETAILED DESCRIPTION

The present disclosure addresses problems associated with the routing of wires through garments by providing systems which, when installed in a garment, provide for both selective and ergonomic wire management. The disclosures provided herein are not intended to be indicative of a particular wire management system to be implemented within a garment, but rather are employed to describe arrangements of garment wire management systems for illustrative purposes.

The term headphone, headphone wire, and headphone jack, are intended to refer to an electronic accessory which, when connected to an electronic device, can supply sound to an individual's ears. Similarly, the terms portable audio playback device, portable media devices, or devices, are intended to refer to an electronic device capable of receiving a headphone jack and supplying electronic signals to the headphone jack for transmission to the headphone via a headphone wire. For clarity, the term "wire" may be interchanged with the term "headphone wire" or other wires and cables which are to be routed through the garment throughout.

The phrase "in some embodiments" and variations on this phrase generally are understood to mean that a particular feature, structure, system, or method being described includes at least one iteration of the disclosed technology. Such phrase should not be read or interpreted to mean that the particular feature, structure, system or method described is either the best or only means by which the embodiment can be implemented. Rather, such a phrase should be read to mean that discussed afterward is a specific way in which the described technology could be implemented, but need not be the only way to do so.

Where the terms "may," "could," or likewise permissive terms are used, the elements following or preceding associated with the permissive term are optional components, features, or steps which need not be included in the overall system or method being described.

Figure 1:
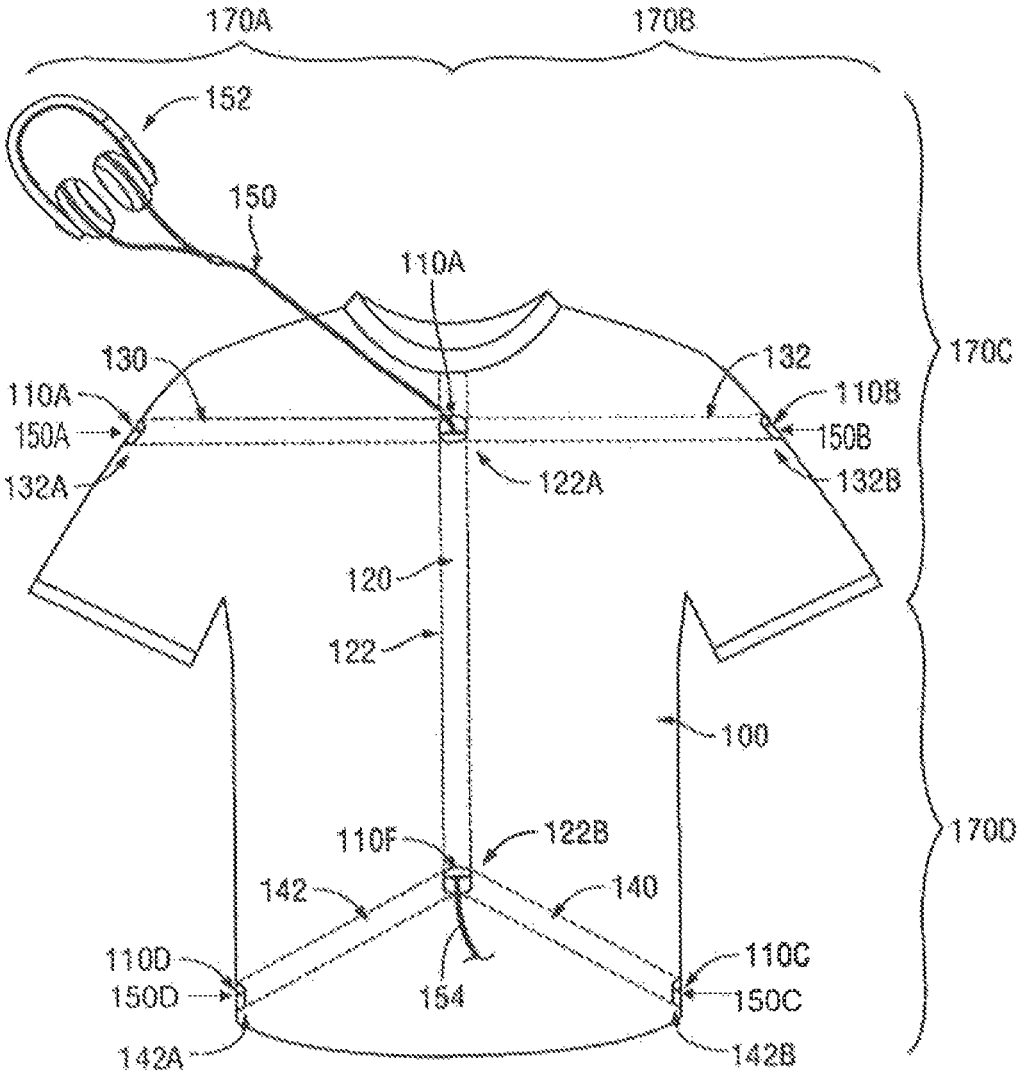
FIG. 1 is an illustration of a garment fitted with a wire control system in accordance with aspects of the present disclosure.

Referring to FIG. 1, illustrated is an embodiment of a wire control system embedded within a garment 100, specifically a t-shirt. The garment 100 as illustrated in FIG. 1 includes a left portion 170A, right portion 170B, upper portion 170C, and lower portion 170D.

Depicted are a series of channels for guiding wire through a garment 100, including an upper channel 130, a lower channel 140, and an elongated channel 120. The upper channel 130 provides primary communication between a left port 110F, a right port 110B, and a center port 110A. The elongated channel 120 provides primary communication between upper port 110A and lower center port 110F. The lower channel 140 provides primary communication between the lower left port 110D, lower center port 110F and lower right port 110C. As a result of the placement of the upper channel 130 toward the top of a garment 100, and individual is permitted to route a wire 150 through the garment 100 in a manner which permits a shortened directed path from the top of the garment 100 to the left port 110F and right port 110B. Likewise, connection of the upper channel 130 to the elongated channel 120 and lower channel 140 permits selective routing of a wire 150 in a manner which an individual finds most ergonomic, depending on their intended activity. It is contemplated that the upper, lower and elongated channel 120, 130, 140 may selectively couple to the garment 100 via, without limitation, buttons, clasps, or other fasteners known in the art.

Consider, for illustrative purposes only, the following example. An individual wearing a garment 100 while cycling might want to run the wire from the center port 110A to either the lower left port 110D or the lower right port 110C. The described network permits such selective wire translation and communication, facilitating connection of a wire 150 to a device attached at the hip or behind the individual.

Similarly, an individual who is using a garment 100 in conjunction with the sport of running might want to run the wire from the center port 110A to either the right port 110B or left port 110F. Such a configuration would permit ultimate connection of a wire 150 to a device located on the upper or lower arm of the individual.

Placement of the upper channel 130 in such a manner, further permits consolidation of excess wire 150 which may reside between the entrance of the wire into the garment 100 and ultimate exit from the garment.

The upper channel 130, lower channel 140 and elongated channel 120 are also interconnected via an upper intersection 160B and a lower intersection 160A. Specifically, the upper channel 130 is connected to the elongated channel 120 at the upper intersection 160B, and the elongated channel is also connected to the lower channel 130 at lower intersection 160A. As a result, a wire 150 may be routed initially via any of the six ports 110A-110F enclosed in the garment 100 of FIG. 1 and may exit the garment through any of the six ports 110A-110F.

Upper channel 130, lower channel 140, and elongated channel 120 further include an upper channel membrane 132, lower channel membrane 142 and elongated channel membrane 122 which restrict the movement of a wire 150 as the wire is translated through the respective channels. The upper channel membrane 132, lower channel membrane 142 and elongated channel membrane 122 terminate at upper channel membrane ends 132A, 132B, elongated channel ends 122A, 122B, and lower channel ends 142A, 142B, respectively.

Ports 110A-110F can be any threshold which permits passage of a wire into and out of a channel membrane 122, 132, 142. Ports may be permanently attached to the garment 100 by stitching, gluing, or any other suitable method of affixing an object to fabric. Alternatively, ports may be created through selective cutting and stitching of a garment 100. In one embodiment, a port is created by creating a small incision into the garment 100, and reinforcing the incision with stitching to buttress the opening on either side of the incision, thereby creating a reinforced opening. Such openings are commonly referred to as single-welts 150A-150D.

In alternative embodiments, port 110A-110F incisions can be reinforced by folding over the fabric or adding additional fabric to the area surrounding the port 110A-110F incision, buttressing the incision to prevent tearing of the fabric. Once the fabric has been folded over, it may be stitched, glued or otherwise affixed to the adjoining fabric.

The upper channel 130, lower channel 140 and elongated channel 120 can be fixed to the garment 100 in a variety of ways including, but not limited to, stitching, gluing, or connecting with a fastener. In one embodiment, the upper, lower, and elongated channel 130, 140, 120 are stitched along two tracts in a continuous fashion, providing for a rigid channel network within the garment 100. In alternative embodiments, zippers, buttons, or other fastening methods known in the art may be used to affix the upper, lower, and elongated channel 130, 140, 120 to the garment 100.

Upper channel 130, lower channel 140 and elongated channel 120 may also be created by layering the fabric of the garment 100 and stitching a channel within the inner and outer layers of the garment 100.

FIGS. 2A-2D are illustrations of embodiments of a port sealer 200.

Figure 2A:
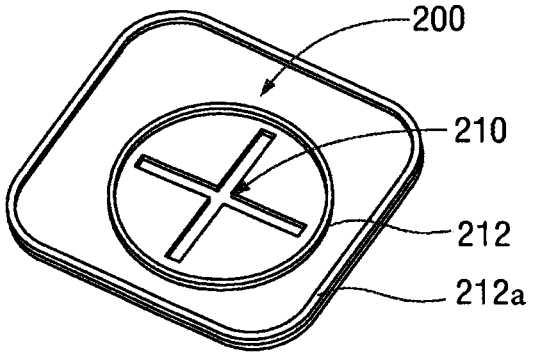
FIG. 2A is an illustration of a port sealer in accordance with aspects of the present disclosure.

FIG. 2A is an embodiment of a port sealer 200. The port sealer 200 has a membrane 214 and an aperture 210 defined by the membrane. The aperture 210 allows for communication between a front and back portion of the port sealer 200. The aperture 210 may have a cross-hair shape which permits a variety of wires 150 to pass through the aperture 210 while maintaining an appropriate amount of tension on the wire 150. It is contemplated that the aperture may have varying shapes and configurations as desired. The port sealer's aperture is also supported by a port sealer buttress 212 which, in conjunction with the port sealer material, reinforces the aperture 210 and allows for repeated insertion of a wire 150 without compromising the aperture 210. Port sealer buttress 212*a* is similar to sealer buttress 212 and therefore, its description has been omitted.

The port sealer 200 membrane can be made of any material which can be bent during insertion of a wire 150 or while a wire 150 is engaged with the port sealer. Some examples of appropriately malleable materials which can form a membrane include plastic, rubber, cotton, nylon, or polyester. Further, the port sealer 200 may be made of multiple materials. It is contemplated that the port sealer 200 may have a first and second portion which are separated by the port sealer buttress 212. An outer portion of the port sealer 200 which is not enclosed by the port sealer buttress 212 may be made of a hard rubber, plastic, metal, or other rigid material. Additionally, an inner portion of the port sealer 200 may be made of a softer or more pliable material, such as silicone, or softer rubber relative. This combination of a harder exterior material and a softer interior material may allow the port sealer to protect a wire 150 as it is engaged with the port sealer 200 while maintaining the position of the wire 150 relative to the port sealer 200.

Figure 2B:
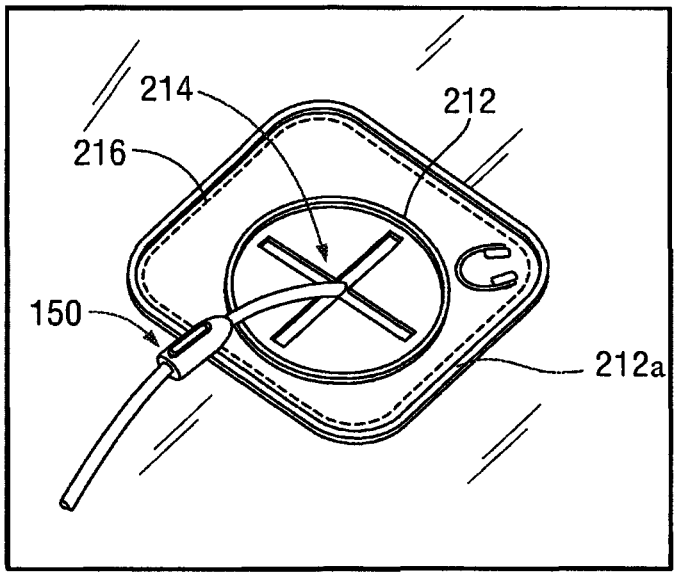
FIG. 2B is an illustration of the port sealer of FIG. 2A located on a garment.

FIG. 2B shows an embodiment of a port membrane of FIG. 2A affixed to a garment 100. The garment 100 includes an incision providing for communication between an outer and inner surface of the garment 100, and is bounded by the aperture 210 of the port sealer 200, the port sealer being stitched to the fabric of the garment 100. As a result of fixing the port sealer 200 to the garment 100, the aperture 210, in conjunction with the incision in the garment 100 permits a wire to pass through the garment 100 in a predefined location. The port sealer 200 also prevents the garment 100 from tears which may result in repeated insertion of a wire 150, or which may result from tugging or other lateral movement against the incision by the wire 150 passing through the garment 100.

In alternative embodiments, the port sealer 200 may be affixed to the garment 100 with any suitable adhesive (e.g. fabric glue, etc.) for attaching the port sealer 200 to the garment 100. The adhesive may be applied to the port sealer by the individual installing the port sealer 200 in order to ensure adequate application of the adhesive. Alternatively, the adhesive may be pre-applied to the port sealer 200. It is contemplated that, where an adhesive is pre-applied, the adhesive may bond immediately on contact with the garment 100, or alternatively may bond once external energy is applied to the garment 100. For example, an individual may apply the port sealer 200, reposition the port sealer 200 as is necessary to line up the port sealer 200 with the port 110A-110F, and then apply heat via an iron to the port sealer 200 and garment 100 so as to activate and bind the adhesive to the garment 100.

Figure 2C:
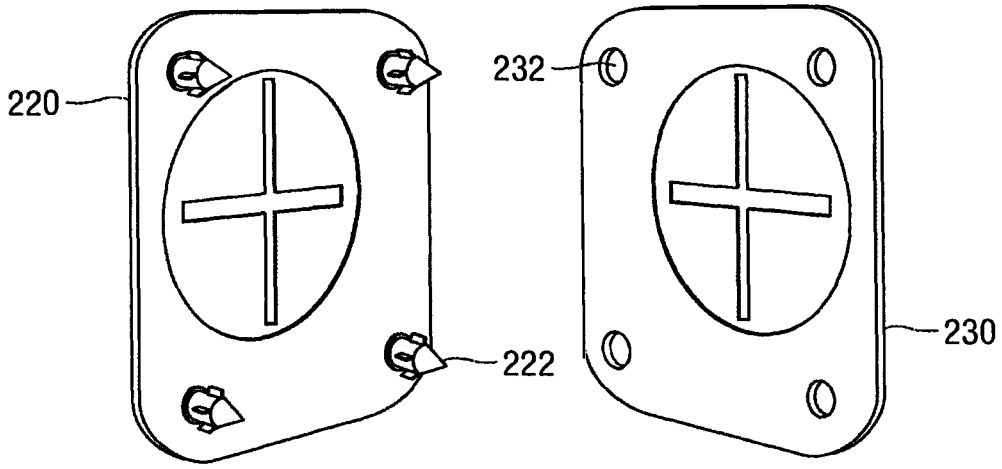
FIG. 2C is an illustration of the port sealer of FIG. 2A.

FIG. 2C is a diagram of a male port sealer 220 and a female port sealer 230 prior to and after coupling. Male port sealer 220 is the port sealer described in FIG. 2A, further including a set of garment 100 fasteners 222 which are received by a receiver 232. Fasteners 222 can be of a variety of types such as studs, eyelets, sockets or buttons.

Figure 2D:
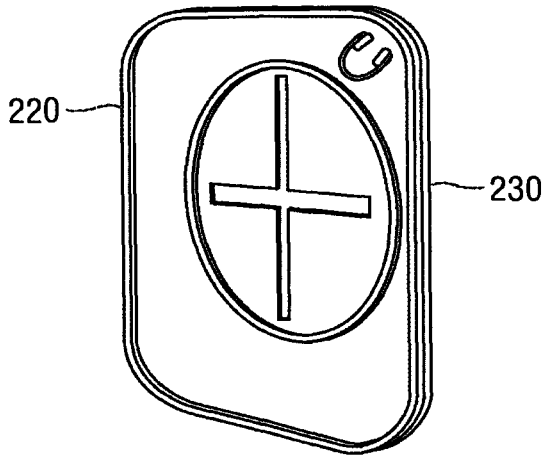
FIG. 2D is another illustration of the port sealer of FIG. 2A.

FIG. 2D is an illustration of the male and female port sealers 220, 230 fixably engaged. As the male port sealer 220 is aligned with the female port sealer 230, when pressure is applied the fasteners 222 located along the male port sealer 220 engage the receivers 232 located along the female port sealer 230. It is contemplated that such engagement of the male and female port sealers 220, 230 may be permanent or selective.

In use, the male and female port sealers 220, 230 operably couple to one another, the fasteners 222 aligning with the receivers 232. The male and female port sealers 220, 230 are positioned over the incision in the garment 100 to bind the incision. The male and female port sealers 220, 230 may, upon coupling, be permanently fixed to one another, and the garment 100 by stitching around the perimeter of the male and female port sealers 220, 230. Alternatively, the male port sealer 220, female port sealer 230, or both male and female port sealers 220, 230 may have an adhesive such as fabric glue applied prior to positioning on the garment 100 and subsequent coupling with one another.

Referring again to FIG. 2C, the male port sealer 220 may include fasteners 222 which do not require engagement with a receiver 232 to be secured to a garment 100. One example of such a male port sealer 220 would be one which has button-type fasteners (not shown) affixed to the male port sealer 220, thereby permitting the male port sealer 220 to be affixed to the fabric of the garment 100.

It is contemplated that male port sealer 220 and female port sealer 230 may be made in part of a magnetic substance. As a result of an at least partial magnetic construction, male port sealer 220 and female port sealer 230 may be constructed without fasteners 222 or receivers 232. The result may provide a male and female port sealer 220, 230 which are easily removable before or after laundering the garment 100. The male and female port sealer 220, 230 may also be constructed of a material designed to enclose the magnetic substance, thereby protecting the magnetic substance from drops and potential demagnetization as well as add comfort if the male and female port sealer 220, 230 come into contact with the individual's skin.

Figure 3:
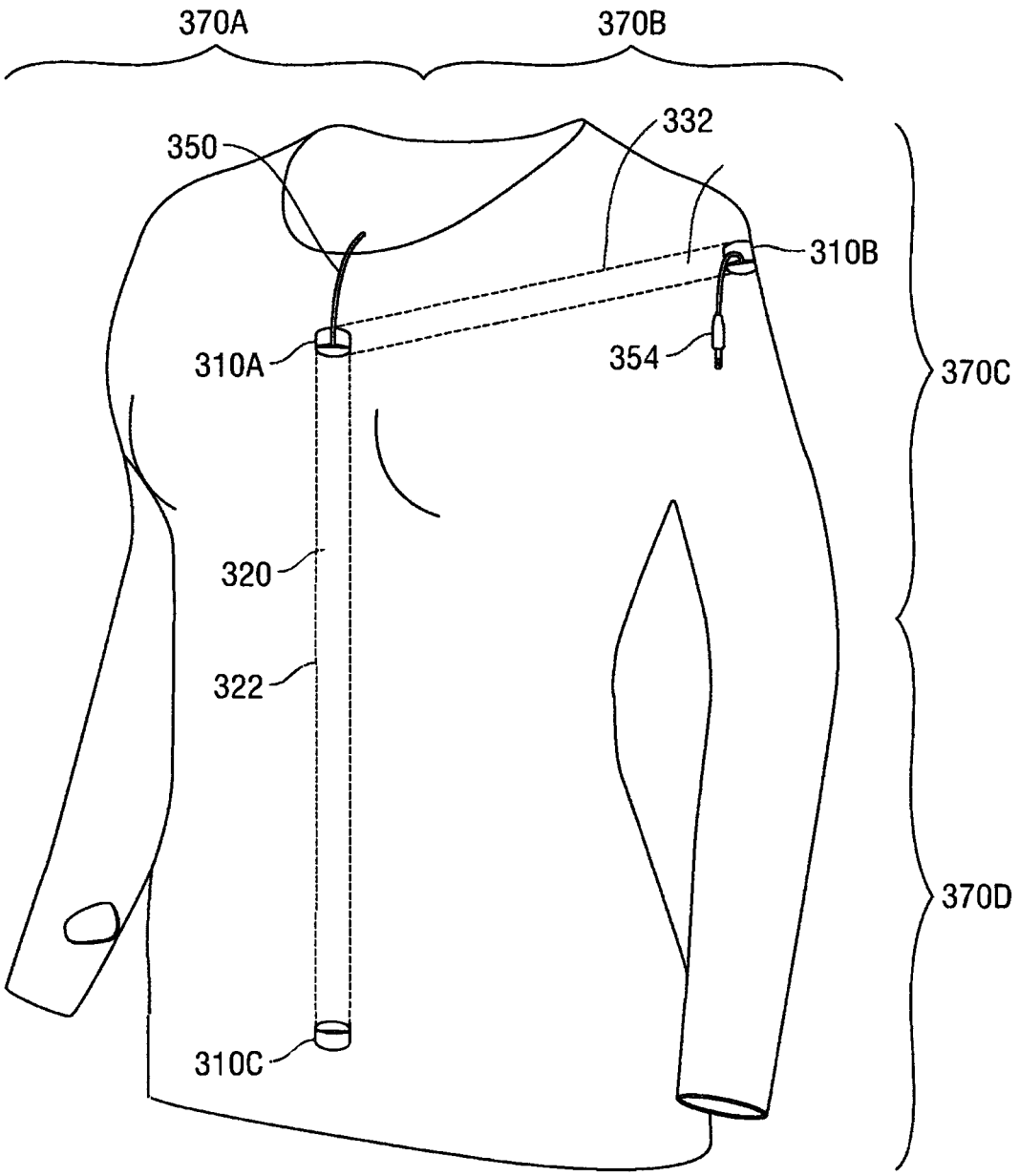
FIG. 3 is an illustration of a wire control system fitted in a garment in accordance with aspects of the present disclosure.

FIG. 3 is another embodiment of a wire control system embedded within a garment 300. The garment 100 as illustrated in FIG. 3 includes a left portion 370A, right portion 370B, upper portion 370C, and lower portion 370D.

Depicted are a series of channels which form an asymmetric wire management network. The wire management network is joined with garment 300 and includes an upper channel 330 and an elongated channel 320, which are connected at upper intersection 360B. Located at upper intersection 360B is also center port 310A which permits entry and exit of wire 350. The elongated channel terminates at lower center port 310C, permitting entry and exit of wire 350. Likewise, upper channel 330 terminates at right port 310B, permitting entry and exit of wire 350. Further, the configuration of the upper channel 330 and the elongated channel 320 permit an individual to route wires in various configurations for various activities, or in conjunction with other garments.

Figure 4:
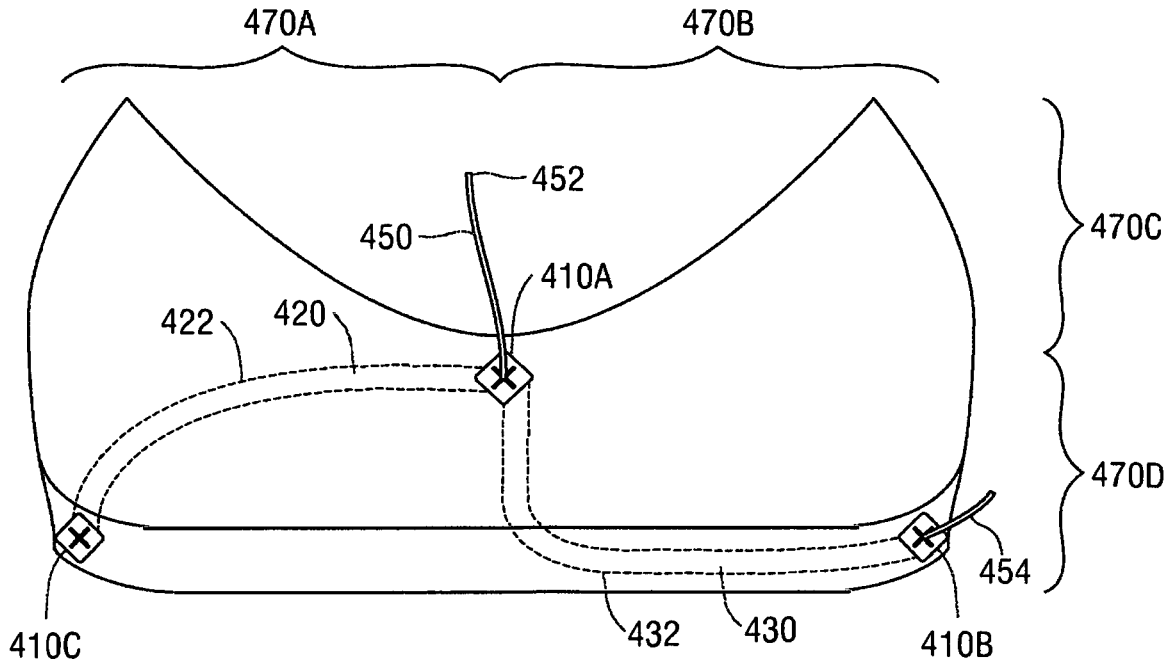
FIG. 4 is an illustration of a wire control system of a wire control system fitted in a garment in accordance with aspects of the present disclosure.

FIG. 4 is an embodiment of a wire control system embedded within an undergarment 400. The garment 400 as illustrated in FIG. 4 includes a left portion 470A, right portion 470B, upper portion 470C, and lower portion 470D.

Depicted are a series of channels 420, 430 which create a wire management network in a female undergarment 400. Left channel 420 originates at left port 410C and terminates at center port 410A. Center intersection 460A permits communication of a wire 450 through left channel 420 and right channel 430, ultimately permitting passage of a wire from any of left port 410C, center port 410B, or right port 410A via a continuous channel across the female undergarment 400.

Configuration of the channels 420, 430 along the undergarment in the manner disclosed permits multiple wiring configurations, thereby providing the individual the ability to route a wire or wires 150 as needed for their chosen activity. Notably, depending on the activity, an individual may chose certain wiring configurations such that obstruction of the individual's range of motion while engaging in the chosen activity is not hindered by any wire or wires 150. For instance, if an individual were to design a configuration for running, they may choose to use channel 420, so that when the wire 150 passes outward toward their ears the wire is located central to their body (not shown). Additionally, when the wire passes outward through port 410C, the wire 150 is easily directed to the individual's pocket or running pack (not shown).

Figure 5:
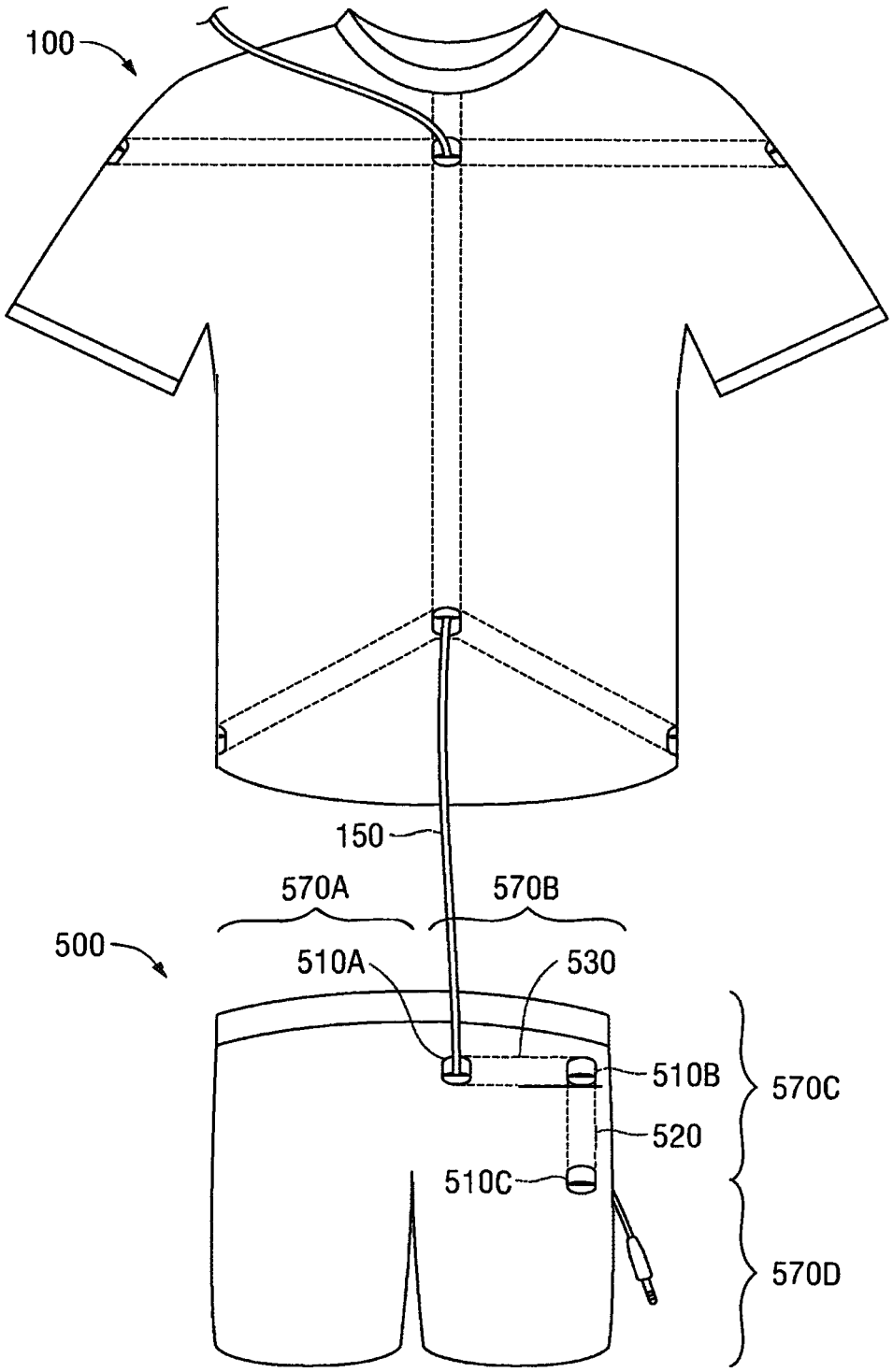
FIG. 5 is an illustration of a first garment and a second garment with complementary wire control systems in accordance with aspects of the present disclosure.

FIG. 5 is an embodiment of a network of channels in a garment system 500, which allow a wire 150 to be coupled to the garment of FIG. 1, as illustrated. The garment 500 as illustrated in FIG. 1 includes a left portion 570A, right portion 570B, upper portion 570C, and lower portion 570D.

Depicted are a series of channels 520, 530 which create a wire management network within garment 500. Right channel 520 is operably connected to upper channel 530 at upper intersection 560B, allowing for continues routing of a wire 550 through upper port 510A to either of right port 510B or lower port 510C.

Notably, when used in combination, the garment 100 of FIG. 1 and the garment 500 of FIG. 5 allow for ergonomic translation of a wire 150, 550 through multiple garments 100, 500. Such configurations are possible either by coordinating pre-manufactured garments, or alternatively by adapting garments to operably receive wire with the port sealers 200, 220, and/or 230. Such results are likewise achievable by combining any of the garments described in this application, or by combining garments generally which are fitted with selective wire control systems.

In some embodiments, port sealer 200 may also be used to create uniquely located ports on garments which are not initially fitted with ports 110A-110F or channels during the garment manufacturing process. As described, the port sealers 200 shown in FIG. 2A-2C may be applied to a garment either before or after an incision is made into the garment, thereby permitting communication of a wire between the interior and exterior of a garment.

In some embodiments, port sealer 200 may be used in conjunction with wiring channels which may also be affixed to a garment after the garment manufacturing process. As a result of selectively positioning port sealers 200 an individual may route wires through garments either according to their personal preference, or in response to the activity which they are performing.

In some embodiments, port sealer 200 may be operably positioned on a series of garments, such as a shirt and a pair of pants, thereby permitting ergonomic routing of wires through multiple garments. By aligning port sealers along multiple garments, an individual may be permitted to create extended wiring networks which address the routing of wires beyond a single garment. Such routing, in turn, can minimize the amount of wire which must be exposed, thereby reducing the chance that a wire may be caught on a foreign object.

Figure 6:
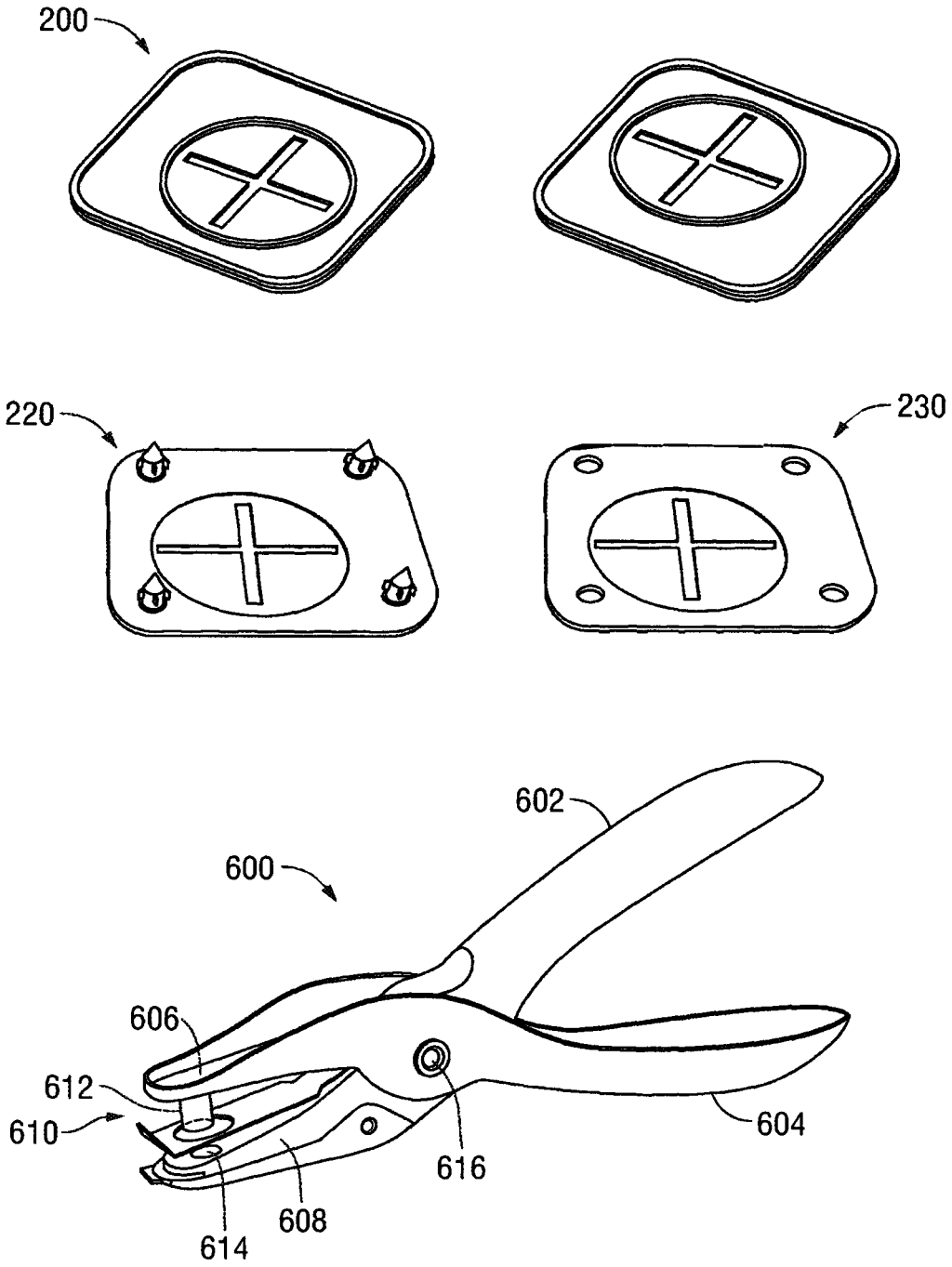
FIG. 6 is an illustration of a kit according to aspects of the present disclosure.

With reference to FIG. 6, it is the port sealer 220 may be combined with a fabric punch 600 as part of a kit for attaching a port sealer 220 to a garment 100. The kit may be included in a package (not shown). Reference will be made to the fabric punch 600 herein using the positional terms "proximal" and "distal", where the term "proximal" herein refers to portions of an object or directions which are translated toward an individual, and the term "distal" herein refers to portions or directions which are translated away from or further form an individual. The fabric punch 600 includes a first and second arm 602, 604 which are configured to be gripped in a hand of the individual. The first and second arm 602, 604 extend distally, and are pivotally coupled by a pin 616. A first and second head member 606, 608 are located distally along the first and second arm 602, 604. The first head member 606 has a cutting member 610 extending therefrom toward the second head member 608, the cutting member 610 configured to be advanced into a receiving portion 614 defined by the second head member 608. The cutting member 610 comprises a hollow cylinder which is sharpened and configured to engage with fabric. More specifically, the cutting member 610 is configured to form a circular hole in fabric as the first and second arm 602, 604 are engaged, thereby driving the cutting member 610 into the receiving portion 614.

With continued reference to FIG. 6, the kit includes the fabric punch 600, a plurality of port sealers 200, 220, 230. The kit may additionally include fabric glue (not shown), a needle and thread (not shown), or other adhesive and/or fixation compounds and materials to couple the port sealers 200, 220, 230 to fabric.

As a result of combining both a fabric punch and a port sealer 220, an individual cutting into a garment 100 prior to or during the affixing of a port 110A-110F can make the cut into the garment 100 without unnecessarily cutting the garment 100 more than is required to permit communication therethrough. As a result of having a cleaner cut prior to placing a port sealer 220 over the newly created port 110A-110F, the port sealer 220 may better protect the port 110A-110F from further tearing into the remaining garment 100 fabric.

It is further contemplated that, in embodiments, the port sealers 200, 220, 230 described may be coated with fabric glue, or an adhesive activated by heat (e.g., iron on adhesives) for coupling the port sealer 200, 220, 230 to fabric. The port sealers 200, 220, 230 may also selectively couple to the upper, lower and elongated channel 120, 130, 140 to permit selective engagement of the upper, lower, and elongated channel 120, 130, 140 to the garment 100 or any other garment on which the port sealers 200, 220, 230 are coupled.

In conclusion, the disclosed technology provides embodiments for purposes of illustration and disclosure. The embodiments disclosed within are not intended to be exhaustive or limiting of the disclosed technology, but rather are discussed to enable one skilled in the art to understand the disclosures described. Various alternatives and equivalents will also become apparent to one of ordinary skill in the art without varying or departing from the spirit of the invention. For example, when the embodiments described above refer to particular features, components, or combinations thereof, such features, components, and combinations may be substituted with functionally equivalent substitutes which may or may not contain the elements as originally described or arranged.

What is claimed is:

1. A shirt for ergonomically routing wires therethrough, the shirt comprising:

an interior surface defining a first aperture, a second aperture, and a third aperture, the first aperture and the second aperture being contained within a first membrane defining a first channel, and the third aperture being coupled to a second membrane defining a second channel, the second membrane disposed along the interior surface of the shirt, wherein the second channel intersects the first channel at a first intersection to permit translation of a wire from the third aperture through the second channel and a portion of the first channel to either of the first or second aperture, wherein the third aperture is disposed between the first aperture and the second aperture; and an exterior surface opposed to the interior surface;

wherein each of the first and second apertures are further defined by a first folded portion and a second folded portion of the interior surface, respectively, the first and second folded portions are coupled to a first unfolded portion and a second unfolded portion of the interior surface, respectively, thereby forming a single-welt about an edge of each of the first and second apertures along the interior surface.

2. The shirt of claim 1, wherein the first aperture is defined by an upper portion of the interior surface of the shirt and the second aperture is defined by a lower portion of the interior surface of the shirt.

3. The shirt of claim 1, wherein the first and second apertures are defined by an upper portion of the interior surface of the shirt, the first and second apertures are further defined by a left portion and a right portion of the interior surface of the shirt, respectively.

4. The shirt of claim 1, wherein the first and second apertures are defined by an upper portion of the interior surface of the shirt and the third aperture is disposed along a lower portion of the interior surface of the shirt.

5. The shirt of claim 1, wherein the third aperture is defined by a lower portion of the interior surface of the shirt and configured to align with an aperture of a garment different from the shirt.

6. The shirt of claim 1, further comprising a fourth aperture defined by the interior surface and the first intersection of the first and second channels.

7. The shirt of claim 6, further comprising a third membrane defining a third channel, the third membrane containing a fifth aperture and a sixth aperture defined by the interior surface below the first and second apertures, respectively, wherein the fifth and sixth apertures are in communication with the third aperture via the third channel.

8. The shirt of claim 7, wherein the third channel defines an inverse-V shape at a bottom portion of the shirt, wherein the third aperture is defined by the interior surface at an apex of the inverse-V shape, and the fifth and sixth apertures are further defined by the interior surface at respective ends of the inverse-V shape.

9. The shirt of claim 1, further comprising a third membrane defining a third channel, the third membrane containing a fourth aperture and a fifth aperture defined by the interior surface below the first and second apertures, respectively, wherein the fourth and fifth apertures are in communication with the third aperture via the third channel.

10. The shirt of claim 1, wherein the first and second membranes each define a tubular cross-section.

11. The shirt of claim 1, wherein the first and second channels are each coupled to the shirt via a fastener, the fastener comprising at least one of glue, a stitch, a zipper, a hook and loop assembly, or a button.

12. The shirt of claim 1, further including a third membrane defining a third channel disposed substantially parallel to the first channel and perpendicular to the second channel, the third membrane disposed at a lower portion of the shirt.

13. A shirt for ergonomically routing wires therethrough, the shirt comprising:

an interior surface defining a first aperture, a second aperture, and a third aperture, each of the first, second, and third apertures are defined by a first folded portion, a second folded portion, and a third folded portion, respectively, of the interior surface, the first and second folded portions are coupled to a first unfolded portion, a second unfolded portion, and a third unfolded portion of the interior surface, respectively, thereby forming a single-welt about an edge of each of the first, second, and third apertures along the interior surface;

wherein the first aperture and the second aperture are coupled to a first membrane defining a first channel that is horizontally disposed along an upper portion of the interior surface, the first and second apertures coupled to opposite ends of the first channel; and wherein the third aperture is coupled to a second membrane defining a second channel vertically disposed along the interior surface, the third aperture coupled to a bottom end of the second channel, and a top end of the second channel intersects the first channel at a first intersection to enable translation of a wire from the third aperture through the second channel and a portion of the first channel to either of the first or second apertures; and an exterior surface opposed to the interior surface.

14. The shirt of claim 13, further comprising a third membrane defining a third channel disposed below the first and second channels, the third membrane containing a fourth aperture and a fifth aperture each defined by the interior surface and configured to enable translation of the wire to the third aperture via the third channel.

15. The shirt of claim 14, wherein the third channel defines an inverse-V shape at a bottom portion of the shirt, wherein the third aperture is defined by the interior surface at an apex of the inverse-V shape, and the fourth and fifth apertures are defined by the interior surface at respective ends of the inverse-V shape.

16. The shirt of claim 13, wherein the first and second membranes are each coupled to the shirt via a fastener, the fastener comprising at least one of glue, a stitch, a zipper, a hook and loop assembly, or a button.

* * * * *